United States Patent [19]

Beran et al.

[11] Patent Number: 5,000,227

[45] Date of Patent: Mar. 19, 1991

[54] PRESSURIZED FLUID CARRIER CONDUIT CONNECTION

[75] Inventors: Robert L. Beran; John DeLigt, both of Covington, Va.

[73] Assignee: Westvaco Corporation, New York, N.Y.

[21] Appl. No.: 413,069

[22] Filed: Sep. 27, 1989

Related U.S. Application Data

[60] Division of Ser. No. 228,842, Aug. 3, 1988, Pat. No. 4,885,060, which is a continuation-in-part of Ser. No. 151,323, Feb. 1, 1988.

[51] Int. Cl.[5] ..... D21F 1/02

[52] U.S. Cl. ..... 138/106; 138/118; 162/216; 162/336; 162/344

[58] Field of Search ..... 79/225; 162/212, 214, 162/336, 344, 347, 216, 380; 739/556, 566; 425/466; 138/103, 106, 108, 109, 118

[56] References Cited

U.S. PATENT DOCUMENTS

| | | |
|---|---|---|
| 1,989,435 | 1/1935 | Wallquist . |
| 2,904,461 | 9/1959 | Washburn et al. . |
| 3,092,538 | 6/1963 | Parker . |
| 3,407,114 | 10/1968 | Springuel . |
| 3,547,775 | 12/1970 | Bossem et al. . |
| 3,846,229 | 11/1974 | Kallmes . |
| 3,853,695 | 12/1974 | Back et al. . |
| 3,888,729 | 6/1975 | Parker et al. . |
| 3,933,966 | 1/1976 | Waris et al. . |
| 3,937,732 | 2/1976 | Radvan et al. . |
| 4,133,713 | 1/1979 | Chuang . |
| 4,565,603 | 1/1986 | Reiner et al. . |

*Primary Examiner*—Timothy V. Eley

*Attorney, Agent, or Firm*—W. A. Marcontell; R. L. Schmalz

[57] ABSTRACT

Flocs of papermaking fiber are dispersed by a multiplicity of white-water jets directed into a papermachine headbox prior to the slice opening. Jet direction is oriented counter-flow to the papermaking stock slice flow to create maximum turbulence, fluid shear and energy dissipation. Such jets issue from nozzle orifices in the slice profiling bar and are supplied with fluid through a two-stage manifold system. To preserve vertical plane pliability of the conduit-connected profiling bar, section area of the profiling bar between nozzles is minimized. Self sealing, push fit, fluid conduit connections with the jet nozzle orifices are made with flexible conduits between a sectional bar type of intermediate header and the profiling bar.

8 Claims, 5 Drawing Sheets

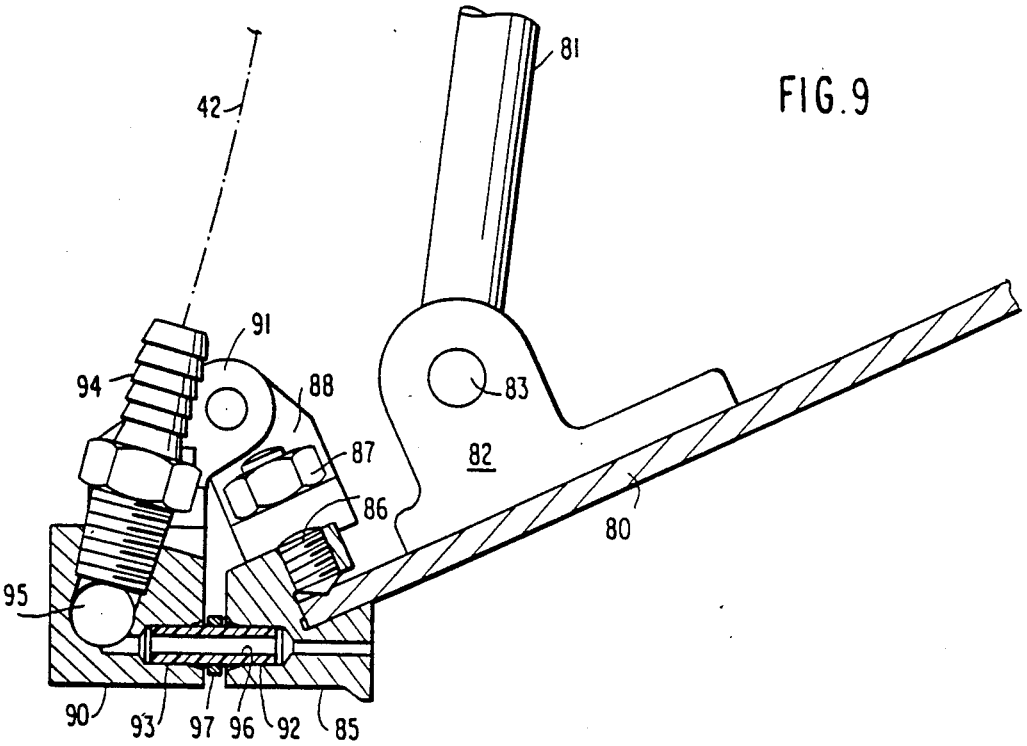
FIG. 9
FIG. 12
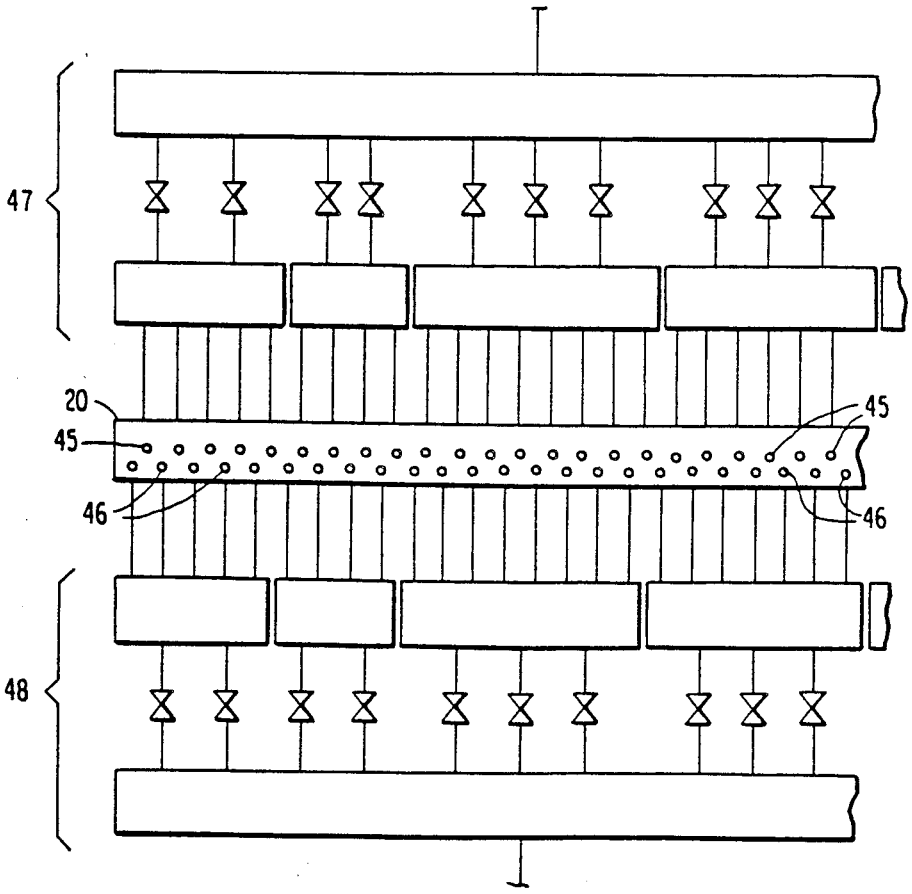

PRESSURIZED FLUID CARRIER CONDUIT CONNECTION

CROSS REFERENCE TO RELATED APPLICATION

This is a division of application Ser. No. 228,842 filed Aug. 03, 1988, now U.S. Pat. No. 4,885,060, which is a Continuation-In-Part of that disclosed in our application Ser. No. 07/151,323 filed Feb. 1, 1988 for a Papermachine Headbox profiling Bar.

BACKGROUND OF THE INVENTION

1. Field Of The Invention

The present invention generally relates to headboxes for fourdrinier papermachines. More particularly, the invention is directed to a method and apparatus for generating a positively controlled degree of micro-scale turbulence in the headbox slice discharge jet.

2. Description Of The Prior Art

Paper and other non-woven webs of fibrous material are traditionally made by depositing a fluidized suspension of fiber such as cellulose pulp, called stock, onto a traveling forming screen characterized as a fourdrinier wire. The rate and distribution of stock deposition upon such a fourdrinier wire is controlled by a headbox assembly which comprises a slice channel opening for discharging an elongated jet of stock onto the moving screen. Liquid vehicle of the suspension, usually water, drains through the screen openings leaving the fiber constituent of the suspension on the screen surface as an accumulated mat.

In an aqueous suspension, cellulose fibers have a considerable affinity to agglomerate into clusters called flocs. This occurs in the system piping and flow channels prior to the headbox. Notwithstanding repeated agitation and mixing to disperse flocs prior to deposit on the screen, many remain to be set into the web formation. These are seen in the finished paper product as a mottled pattern of birdseyes and dark or dense spots or areas. Such non-uniformity of fiber distribution is the source of numerous paper converting and printing difficulties.

Several devices and techniques are used, have been used or proposed to disperse flocs prior to setting on the screen. The commonly used headbox holey-roll is representative. The objective in all such proposals is to induce a high degree of micro-scale turbulence across the span of the discharge jet for floc dispersion. Fluid and boundary layer shear are the usual energy source of such turbulence. For example, white water or low consistency stock may be discharged from numerous sources around the slice nozzle at high velocity into the headbox final flow channel prior to the slice.

Efficient generation of micro-scale turbulence in a headbox slice flow stream is therefore one objective of the present invention. This is accomplished in a manner similar to that disclosed by U. S. Pat. No. 2,904,461 wherein numerous jet sources of white water or thin stock are discharged into the headbox from the front wall thereof and in a counter flow direction to the stock within the headbox.

An additional objective of the present invention is to teach a convenient structure by which such fresh or white water jets are integrated into the headbox assembly.

Another objective of the present invention is to teach the construction of a malleable slice profile bar having integral discharge jets for turbulence generation and floc dispersion.

Another objective of the present invention is to teach a fluid distribution system for headbox turbulence generation that may be added as a post-construction accessory to most existing headboxes of prior art construction.

SUMMARY

These and other objects of the present invention are served by a slice profile bar having mounting or assembly interface dimensions and characteristics compatible with the headbox of intended use. Additionally, the present profile bar is provided with an unusually heavy edge section to accommodate a series of nozzle orifices distributed along the bar length about one inch or less apart set at an angle to the profiling bar plane of 50 to 90 degrees.

With each orifice is a flexible conduit connector by which the respective orifice receives the appointed liquid, clear or white water, from an intermediate or secondary distribution manifold. Being a relatively heavy and rigid structural element, the second manifold is independently secured to the headbox structure.

Where possible, such as between profile adjustment rods or linkage, the present profile bar is cut or notched in nonfunctioning areas to reduce the bar rigidity in the vertical adjustment plane.

Preferably, a larger, primary manifold is also provided from an independent headbox suspension to supply the secondary manifold. In the preferred embodiment of the invention, the secondary manifold is segmented to serve only a small number of profile bar nozzles respective to each segment. Each secondary manifold segment therefore, has independent supply flow connection to the primary manifold. The fluid flow rate and/or pressure to each of these supply connections may be independently controlled over a pressure range of 0 to 60 psi.

BRIEF DESCRIPTION OF THE DRAWING

Relative to the several figures of the drawing wherein like reference characters designate like or similar elements throughout the several drawing figures.

FIG. 9 is an elevational end section of an embodiment of the invention as applied to an adjustable slice lip style of headbox.

FIG. 12 is an alternative flow schematic of the invention.

DESCRIPTION OF THE PREFERRED EMBODIMENT

Figure 1:
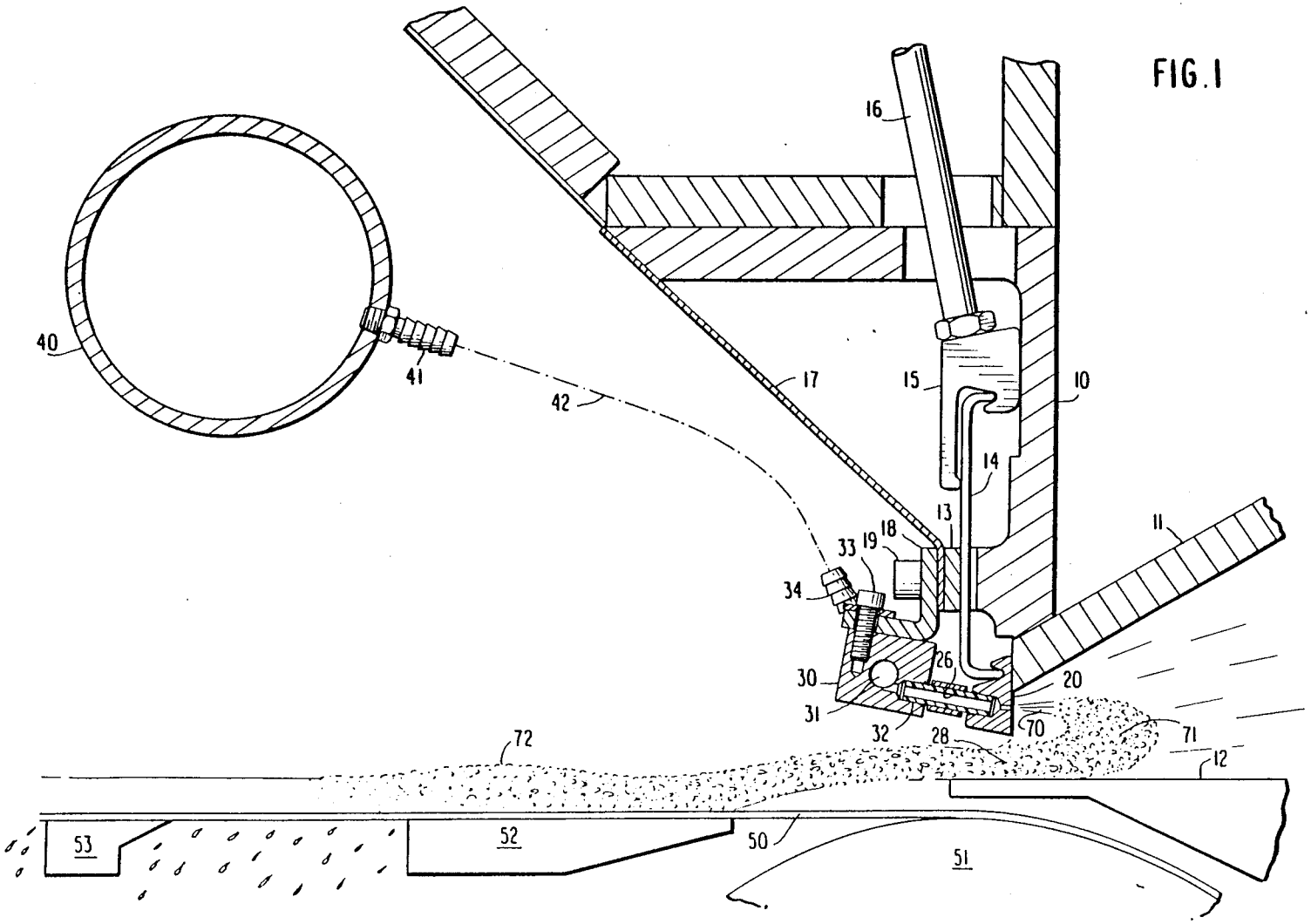
FIG. 1 is a dynamic illustration of the invention as seen in a sectional elevation.

For initial orientation, reference is first given to FIG. 1 where the stock discharge region of a papermachine headbox is shown in detail. Headbox construction in this region generally includes a front wall 10 which supports a slice beam 11 to form a top surface for the exit flow channel to the slice opening 28. The bottom surface is formed by a slice apron 12.

Figure 3:
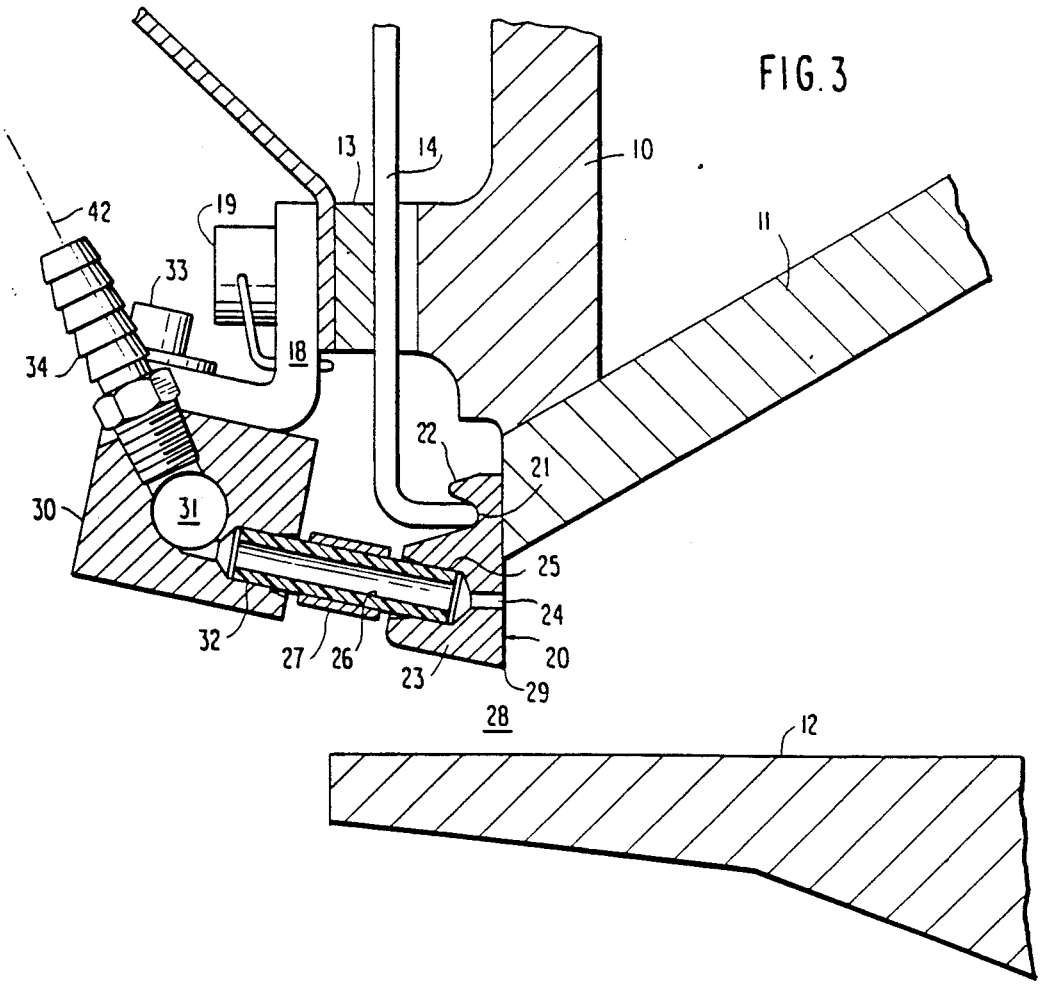
FIG. 3 is an elevational section detail of the invention.

On the rigid slice beam style headbox as represented by FIGS. 1 and 3, a slice profile bar 20 is held against the lower end surface of the slice beam 11 by steel spring clamps 14. These clamps are fulcrumed against a clamp bar 13 secured to the front wall 10 by machine screws 19. Horns are provided at both ends of the spring clamps 14 for push-pull adjustment of the profile bar lower edge 29.

The lower horn of the spring clamp 14 nests into a saddle section 21 between an abutment ridge 22 and the bar body 23. The upper horn of the spring clamp hooks into a profile adjustment block 15. A jack rod 16 threads into the adjustment block for sensitive control over the vertical position of the block 15. Through the mechanical linkage of the spring clamp 14, the lower edge 29 of the profile bar is adjusted accordingly.

Since the profile bar 20 is a continuous and integral element, relative displacements of the lower edge 29 are accomplished by stressing and bending the profile bar body 23 in the vertical plane. Usually, these clamping-/vertical adjustment points represented by the spring clamps 14 are spaced across the front wall 10 on 6 to 8 inch centers.

For environmental protection of the adjustment block/jack rod assembly, a splash shield 17 is secured to the clamp bar assembly 13.

Distinctive of the present profile bar 20 is a series of hydraulic jet nozzles or orifices 24 for discharge of clear or white water into the headbox final flow channel in a direction substantially opposite to the slice flow.

Orifice diameters of 1/16 inch to ⅛ inch have been used at centerline spacings of ½ inch to 1 inch. Orifice discharge axes have been used at orientation angles of 50 to 90 degrees relative to the vertical plane of the profile bar with the primary vector component directed against the stock slice flow direction. Dilutent water supply pressures are variable from 0 to 60 psi. The exact combination of orifice diameter, spacing, orientation angle and applied dilutent water pressure is determined by the stock slice flow rate and degree of fiber dispersion required.

Figure 2:
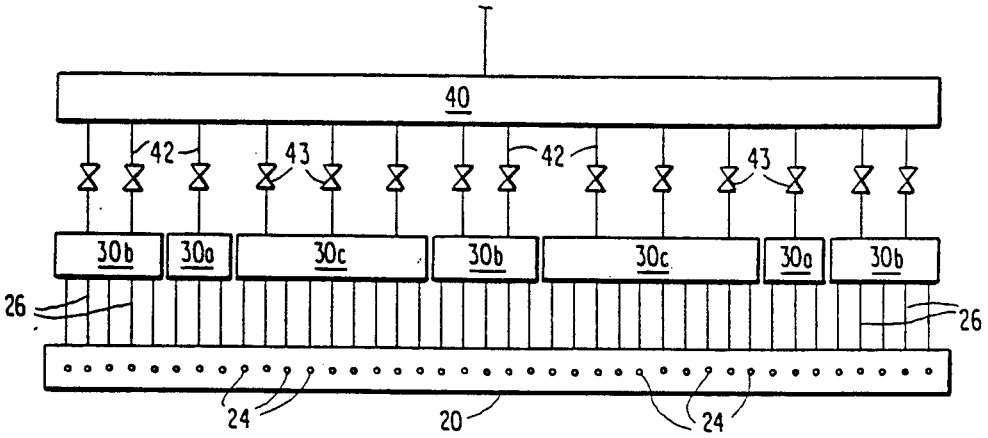
FIG. 2 is a flow schematic of the invention.

With reference to FIG. 2, it is seen that each orifice is fluid flow connected to a secondary manifold 30 by a flexible conduit 26. The secondary manifold is supplied from a singular primary manifold 40 through flexible conduits 42 that are flow controlled by valves 43.

The secondary manifold 30 may be segmented into a plurality of independently mounted manifolds **30*a*, 30*b* and 30*c* of different size. This characteristic may be motivated by physical interferences from other headbox structure and by maintenance considerations. For example, each secondary manifold section 30*a*, 30*b* or 30*c* may be removed from service for cleaning or other maintenance without affecting operation of the other manifold sections. Such independent mounting includes respective brackets 18 which are secured to the clamp bar 13 by machine screws 19. Other machine screws 33 secure the manifold section to the bracket 18**.

Due to the number and density of fluid connections between the secondary manifold 30 and the profile bar 20, traditional conduit connectors can not be used.

There being no available space between adjacent conduits 26 for wrenches, threaded connections between the profile bar nozzles 24 and the manifold flow channel 31 would be impossible. To resolve this difficulty, a push-fit assembly is provided whereby short sections of relatively soft tubing such as polypropylene or polyvinylchloride are used as both conduit and connector. Seating sockets or bores 25 and 32 are formed in the profile bar 23 and secondary manifold 30, respectively. The manifold bores 32 open into the manifold flow channel 31 whereas the profile bar bores 25 connect with the bar nozzles 24.

Short, straight nipple sections of tube 26 connect respective bore sets 25 and 32: the axial length of each tube 26 being approximately equal to the axial distance between the two substantially aligned socket bases at the bottom of the respective bores. The tube 26 outside diameter is coordinated to the seating bore inside diameter by a slight compression fit. Depending on the exact properties of the tube material used and the tube wall thickness, this specification usually requires an inside seating bore diameter slightly smaller, 5% for example, than the outside diameter of the tube 26. Penetration depth into the bore sockets is also about one tubing diameter.

In the FIG. 1 and 3 embodiment of the invention, the tube 26 mid-length is snugly surrounded by a sleeve 27 of steel or other rigid material. Whether such a sleeve 27 is required for any particular application depends on the distance between the secondary manifold 30 and the profile bar 20. When the manifold and profile bar are sufficiently close, no sleeve 27 is required. No positive mechanical connection between the sleeve 26 and manifold 30 or profile bar 20 is made or required. When pressurized with water, the flexible tube 26 expands against the rigid sealing bores 25 and 32 to form a fluid tight fit. This will occur, of course, only if the axial or column rigidity of the tube 26 is sufficient to withstand the axial compression forces imposed by the internal fluid pressure against the hose wall end annulus without buckling or otherwise moving away from either of the socket bore seats. Such rigidity is assured by either a short tube length between rigidly positioned bores 25 and 32 or a reinforcing sleeve 27 tightly surrounding the tube.

Like the secondary manifold 30, primary manifold 40 is also independently suspended from the headbox structure. Since the spacing between adjacent fluid conduits 42 is ample, traditional nose nipples 34 and 41 are used. As noted from FIG. 2, these conduits may be fitted with valves 43 or other flow rate regulation devices to balance or otherwise adjust the fluid discharge rate from each secondary manifold served set of profile bar nozzles 24.

Figure 4:
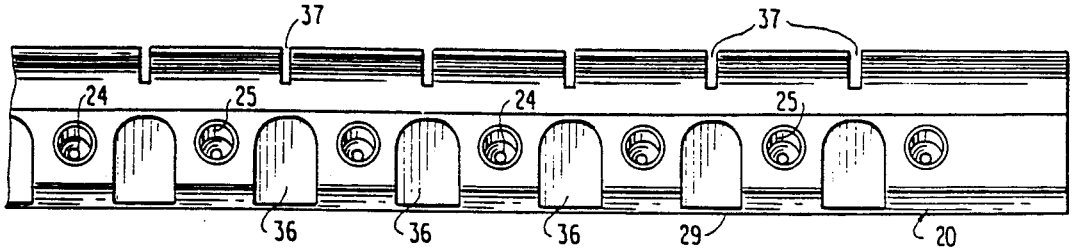
FIG. 4 is an elevation of a first profile bar embodiment.
Figure 5:
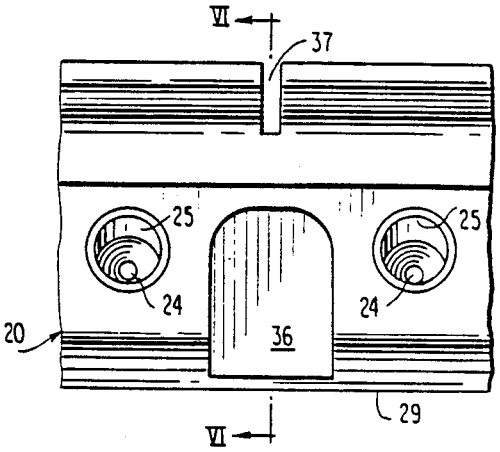
FIG. 5 is a detail of the profile bar represented by FIG. 4.
Figure 6:
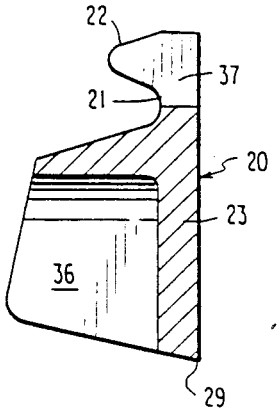
FIG. 6 is an end section of the profile bar represented by FIGS. 4 and 5.

To provide sufficient depth and interface area for each conduit sealing bore 25, it is necessary to enlarge the profile bar section thickness for each nozzle 24. Were this enlarged sectional thickness used continuously along the profile bar length, the bar would be excessively stiff in the vertical plane thereby frustrating or defeating the vertical adjustability of the bar element. To preserve that plane of adjustability, the bar sectional thickness is reduced between each nozzle 24 in the manner illustrated by FIGS. 4, 5 and 6. Midway between each nozzle 24 orifice is a niche 36 in the profile bar body 23. In vertical alignment with the niche 36 centerline is a notch 37 in the profile bar clamping saddle ridge 22. In these sectional planes between the nozzles 24, only a thin web of material 23 remains of the unusually thick bar strip as shown by FIG. 6.

Figure 8:
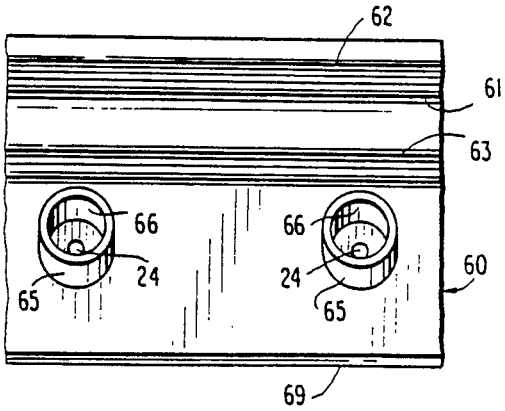
FIG. 8 is a frontal detail of the second profile bar embodiment.
Figure 7:
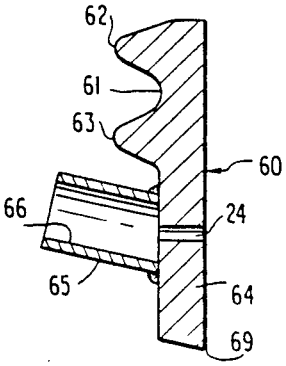
FIG. 7 is an end section of a second profile bar embodiment.

FIGS. 7 and 8 illustrate an alternate design for the nozzle perforated bar of the present invention. In this embodiment, a continuous section, thin web bar may be modified by the addition of a smooth bore, cylindrical coupling 65 around each nozzle orifice 24. For example, a prior art profiling bar 60 is modified according to the present invention with nozzle perforations 24 of 3/32 inch orifice diameter spaced at approximately ¾ inch spacings within a flat area between the lower profiling edge 69 and the lower spring saddle ridge 63. As in the FIG. 1 embodiment, a saddle 61 between ridges 62 and 63 confines the lower horn of clamping spring 14. To the front or outside face of the body section 64, a coupling connector 65 is secured by welding or silver soldering. The internal bore 66 of this coupling is compatible with the flexible tubing 26 so as to seal upon water pressurization.

Having described the mechanical elements of the invention, reference is returned to the dynamic illustration of FIG. 1. Paper stock from within the headbox rushes toward the slice opening 28 against the opposing flow of water jets 70 issuing from nozzles 24. Mixture of these opposing flows creates a zone 71 of extreme turbulence wherein the total energy of the stock is substantially dissipated. Both micro and macro scale turbulence continues out the slice opening and lands upon the fourdrinier screen 50 coming from the breast roll 51. Forming board 52 supports the screen 50 in the landing zone. The screen is further supported by a number of drainage foils 53 which also induce a pressure differential across the screen carried mat of stock. Between the foils 53 and forming board 52, water from within the stock is drained through the screen 50 into a white water pit not shown.

As represented by the drawing, stock issue from the slice 28 is churning with microscopic eddys which are generated within the headbox and continue onto the wire until the mat is set by water removal. Such energetic turbulence dissipates the previously formed fiber clusters and flocs. Depending upon the nozzle 24 discharge pressure and flow rate, the slice flow gives the appearance of boiling beyond the forming board. Moreover, representative of the macro energy dissipation, there is a standing wave 72 above the forming board 52. As a consequence, the fiber constituency of the stock is homogenously dispersed within the screen supported pond at the moment the formation is permanently set.

As an unexpected advantage of the invention, it has been learned that it also influences the strength orientation of a paper web. Normally, machine laid paper is 50% stronger in the machine direction than in the cross-machine direction. From experience with the present invention, water flow rate from nozzles 24 may be adjusted to achieve an approximately square sheet wherein the machine direction strength is substantially the same as the cross-direction strength. Although this characteristic is not desirable for all paper, depending on the use and application of the sheet, in some utilities the property is very desirable. A means to regulate the strength orientation is always desirable.

FIGS. 1-8 have described the invention as applied to headboxes having a rigidly fixed slice beam 11 and an independently adjustable profile bar 20. FIG. 9 shows the invention as applied to a different style of slice adjustment mechanism: one in which the slice beam, characterized as a slice lip 80, is adjustable by numerous, directly connected jack rods 81. Pillow blocks 82, secured rigidly to the upper or exterior surface of the slice lip 80, pivotally connect the lower end of each jack rod 81 with a journal pin 83. In this embodiment of the invention, the profile bar 85 is rigidly secured to the slice lip 80 end by closely spaced set screws 86. Relative adjustment of the numerous jack rods 81 bends the profile bar 85 along with warp distortions of the slice lip 80.

Such headbox construction provides no convenient structure from which the secondary manifold 90 may be suspended. To accommodate this deficiency, the fixed half of a hinged bracket 88 is clamped to the profile bar 85 by lock nuts 87 on each set screw 86. A corresponding swinging half 91 to the hinged bracket is secured to the secondary manifold 90.

As in the FIG. 1 embodiment, flexible tubing sections 96 connect aligned seating bores 92 and 93 in the profile bar and secondary manifold, respectively. A rigid sleeve 97 surrounds the outside girth of the tubing section to restrain pressure expansion. A tubing nipple 94 connects hosing 42 from the primary manifold 40 to the secondary manifold flow channel 95.

Figure 10:
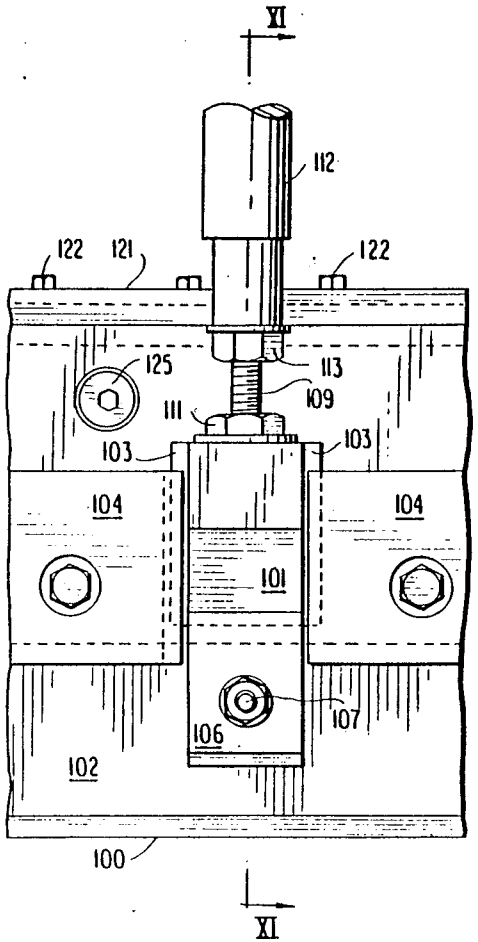
FIG. 10 is a frontal detail of a third type of headbox slice control device integrated with the present invention.
Figure 11:
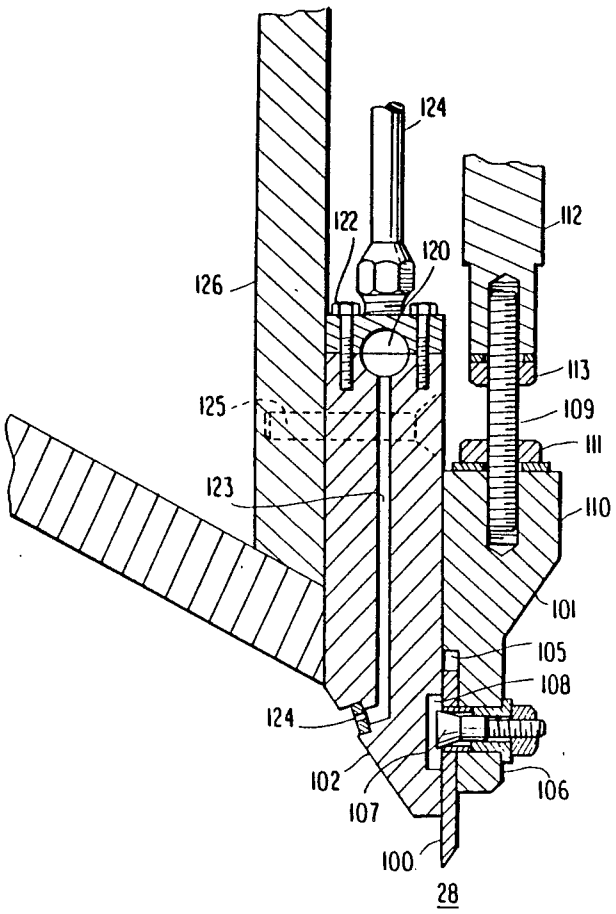
FIG. 11 is an end section of the FIG. 10 slice control device.

Another embodiment of the invention, as represented by FIGS. 10 and 11, is based upon a third type of headbox slice construction wherein an extremely thin profiling bar 100 extending continuously across the headbox slice opening 28 is secured to a multiplicity of adjustment blocks 101. The blocks are held to the outer face of a relatively thick slice bar 102 by means of clamping flanges 103. A stepped relief guide way in the lateral edges of adjacent clamping plates 104 bear against the flange 102 faces to secure the block 101 back face to the outer face of slice bar 102.

A stepped section 105 in the block 101 back face receives the profiling bar 100 under an overhanging projection 106. Through aligned holes in the projection 106 and the profiling bar, a compression collet 107 is inserted to hold the profiling bar to the block 101. A clearance relief channel 108 in the outer face of profiling bar 100 accommodates the backside projection of the compression collet 107 thereby permitting the back face of profiling bar 100 to uniformly engage the front face plane of slice bar 102. The lower end of a threaded linking rod 109 is turned into the upper boss section 110 of the adjustment block 101 and secured by a compression nut 111. The upper end of this linking rod 109 is received by a push/pull adjusting rod 112 and secured by compression nut 113.

Along the upper edge of slice bar 102 is milled the lower half of a trough or channel conduit 120. The upper half of this conduit is cut into a header bar 121 which is clamped to the upper edge of the slice bar by cap screws. Nozzle conduits 123 connect respective water jet nozzles 124 with the channel conduit 120 which serves as a secondary manifold. One or more secondary supply conduits 124 distributed along the length of channel 120 provide fluid supply from a primary distribution manifold not shown.

Machine screws 125 through the slice bar body secure the slice control assembly to the headbox front face 12.

Due to the mass and thickness of the slice bar 102, this FIG. 10 and 11 embodiment of the invention integrates the secondary fluid distribution system with slice bar 102 thereby eliminating the need for external connections between the secondary manifold and the nozzles 124.

FIG. 2 illustrated a single orifice row arrangement of the invention. One alternative arrangement is schematically shown by FIG. 12 with two row levels of orifices 45 and 46 to provide a maximum orifice density and operational flexibility not available from the single row configuration. The FIG. 12 double row configuration includes independent dilution water supply systems 47 and 48 whereby distinctive energy levels, i.e. different pressure drives, are discharged from the respective nozzle rows. Obviously, the orifice axes may be set at respective discharge angles to further refine the stock dispersion mechanism.

Although the invention has been described in terms of papermaking with cellulose fiber, it should be understood to include products laid from aqueous slurries of man-made fiber and mixtures of the two.

Having fully described the preferred embodiments of my invention,

We claim:

1. A pressurized fluid conducting conduit comprising a length of soft, flexible tubing connecting two, axially aligned, rigidly positioned, tubing end fixtures, said end fixtures being separated at rigid operational positions by an axial distance therebetween whereat pressurized fluid is carried between said end fixtures by said flexible tubing, means to selectively expand said axial distance, at least one of said tubing end fixtures comprising a cylindrical bore socket for receiving a respective distal end of said flexible tubing, said bore socket having an inside diameter and minimum depth substantially the same as said flexible tubing outside diameter and rigid sleeve means surrounding said flexible tubing between said end fixtures to restrain the radial expansion of said flexible tubing when pressurized fluid is carried thereby.

2. A conduit as described by claim 1 wherein said end fixture bore socket inside diameter is about 5% less than said flexible tubing outside diameter.

3. A conduit as described in claim 2 wherein said tubing is formed of polypropylene.

4. A conduit as described by claim 2 wherein said flexible tubing is formed of polyvinylchloride.

5. A pressurized fluid conduit apparatus comprising:

a pair of rigidly positioned, axially aligned, tubing end fixtures separated by an axial distance therebetween whereat pressurized fluid is carried between said end fixtures by flexible conduit;

means to selectively expand said axial distance between said end fixtures;

a segment of soft, flexible fluid tubing disposed between said end fixtures, said tubing having a length corresponding to said axial distance and a substantially circular outside diameter;

said tubing end fixtures having a cylindrical socket to receive respective distal ends of said tubing, said sockets having a depth and inside diameter approximately equal to said tubing outside diameters; and rigid sleeve means surrounding the length mid-section of said tubing between said sockets to resist radial expansion of said tubing due to fluid pressure therein.

6. A pressurized fluid conduit apparatus as described by claim 5 wherein said cylindrical socket inside diameters are about 5% less than said tubing outside diameter.

7. A pressurized fluid conduit apparatus as described by claim 6 wherein said flexible tubing is formed of polypropylene.

8. A pressurized fluid conduit apparatus as described by claim 7 wherein said flexible tubing is formed of polyvinylchloride.

* * * * *